US011585056B2

(12) United States Patent
Carter

(10) Patent No.: US 11,585,056 B2
(45) Date of Patent: Feb. 21, 2023

(54) WEIGHTED UNIT FOR HOLDING DOWN TEMPORARY OR REMOVABLE TRAFFIC STANDS, SIGNS AND OTHER OBJECTS

(71) Applicant: Jodi Carter, Baytown, TX (US)

(72) Inventor: Jodi Carter, Baytown, TX (US)

( * ) Notice: Subject to any disclaimer, the term of this patent is extended or adjusted under 35 U.S.C. 154(b) by 539 days.

(21) Appl. No.: 16/658,775

(22) Filed: Oct. 21, 2019

(65) Prior Publication Data

US 2020/0123722 A1 Apr. 23, 2020

Related U.S. Application Data

(60) Provisional application No. 62/748,101, filed on Oct. 19, 2018.

(51) Int. Cl.

| | |
|---|---|
| ***E01F 9/688*** | (2016.01) |
| ***E01F 9/673*** | (2016.01) |
| ***E01F 9/692*** | (2016.01) |
| ***G09F 15/00*** | (2006.01) |

(52) U.S. Cl.

CPC ..... *E01F 9/688* (2016.02); *E01F 9/673* (2016.02); *E01F 9/692* (2016.02); *G09F 15/0056* (2013.01)

(58) Field of Classification Search

CPC ..... E01F 9/688; E01F 9/692; G09F 15/0056

See application file for complete search history.

(56) References Cited

U.S. PATENT DOCUMENTS

| | | | | | |
|---|---|---|---|---|---|
| 3,809,007 | A * | 5/1974 | Brown | E01F 9/654 | 116/63 P |
| 3,851,616 | A * | 12/1974 | Brown | E01F 9/688 | 116/63 P |
| 4,596,489 | A * | 6/1986 | Mariol | E01F 9/642 | 404/9 |
| 4,889,067 | A * | 12/1989 | Provence, Jr. | E01F 9/688 | 116/63 P |
| 5,094,422 | A * | 3/1992 | Tiffany | F42B 4/20 | 248/346.03 |
| 5,201,599 | A * | 4/1993 | Kulp | E01F 9/692 | 116/63 P |
| 5,560,732 | A * | 10/1996 | Kulp | E01F 9/654 | 116/63 P |
| 5,713,694 | A * | 2/1998 | Monda | E01F 9/654 | 116/63 P |
| 5,860,386 | A * | 1/1999 | Schwab | E01F 9/654 | 116/63 P |

(Continued)

*Primary Examiner* — Nimeshkumar D Patel
*Assistant Examiner* — Tania Courson
(74) *Attorney, Agent, or Firm* — David B. Tingey; Bryant J. Keller; Kirton McConkie

(57) ABSTRACT

A weighted unit is provided. The weighted unit includes an enclosed shape, the shape having horizontal channels running along the entire base of the unit from one side to an opposing side, such that the horizontal channel is open to each opposing side, the weighted unit being placed over a horizontal and/or vertical member of an object to be held down with the channel engaging the horizontal member to hold the object in place. Protrusions or other features are integrally formed in the weighted unit to allow the weighted unit to hang from the object to be weighed down without the weighted unit touching the ground. The weighted unit may be placed directly over the top of a horizontal member of the object to be weighed down without also engaging, or being placed around, a vertical component of the same object.

20 Claims, 4 Drawing Sheets

(56) References Cited

U.S. PATENT DOCUMENTS

| | | | | | |
|---|---|---|---|---|---|
| 5,888,016 | A * | 3/1999 | Ahn | E01F 9/692 | 116/63 C |
| 5,908,262 | A * | 6/1999 | Ahn | E01F 9/675 | 116/63 P |
| 6,079,899 | A * | 6/2000 | Green | E01F 9/553 | 116/63 P |
| 6,199,504 | B1 * | 3/2001 | Freeman | E01F 9/688 | 116/63 P |
| 7,007,420 | B2 * | 3/2006 | Garcia | E01F 9/688 | 116/63 P |
| 7,056,055 | B1 * | 6/2006 | Kuo | E01F 9/654 | 404/9 |
| 2003/0136329 | A1 * | 7/2003 | Garcia | E01F 9/629 | 116/63 C |
| 2004/0237875 | A1 * | 12/2004 | Garcia | E01F 9/654 | 116/63 C |
| 2005/0012083 | A1 * | 1/2005 | Braverman | E01F 9/688 | 256/1 |
| 2007/0113774 | A1 * | 5/2007 | Kuo | E01F 9/654 | 116/63 C |
| 2007/0241255 | A1 * | 10/2007 | Dvoracek | G09F 15/0056 | 248/346.01 |
| 2008/0011221 | A1 * | 1/2008 | Dvoracek | E01F 9/654 | 116/63 C |

* cited by examiner

WEIGHTED UNIT FOR HOLDING DOWN TEMPORARY OR REMOVABLE TRAFFIC STANDS, SIGNS AND OTHER OBJECTS

RELATED APPLICATIONS

This application claims priority to U.S. Provisional Application No. 62/748,101, which was filed Oct. 19, 2018, and is entitled WEIGHTED UNIT FOR HOLDING DOWN TEMPORARY OR REMOVABLE TRAFFIC STANDS AND SIGNS AND OTHER OBJECTS; the entire disclosure of which is hereby incorporated.

BACKGROUND

Technical Field

The present disclosure relates to weighted units for holding down objects. More particularly, the disclosure relates to weighted units for holding down traffic stands and signs as well as other objects.

State of the Art

Construction on roadways is constant, necessary, and of course expensive. One of the main expenses is temporary, removable traffic signs, signals, and barricades. Many of these objects are required to be able to stay in place without permanently affixing them to the road, sidewalk or other permanent structure that is part of what is being worked on.

The desire to provide a system for holding traffic signs and signals in place without affixing them permanently to the roadway is present in the relevant arts and other measures have been introduced. Many of these current products include complicated components, easily deteriorating components, such as sand bags, and costly parts. For example, other current products include fabricated frames that require several precision pieces of metal to be welded to one another, or include sandbags that rip, tear or split with ease or after repeated use.

It would therefore be advantageous in the relative arts to improve upon these alternative systems and provide a simpler, more efficient, and cost-effective apparatus to hold down traffic stands and signs, among other objects, as needed.

SUMMARY

The present disclosure relates to weighted units for holding down objects. More particularly, the disclosure relates to weighted units for holding down traffic stands and signs as well as a variety of other objects, which utilize frames or other attachments which need to be affixed to the ground in a non-permanent manner.

An aspect of the present disclosure includes a weighted unit comprising one or more sides formed together to create an enclosed shape, the weighted unit having horizontal channels running along the entire base of the unit from one side to an opposing side, such that the horizontal channel is open to each opposing side, the weighted unit being placed over a horizontal and/or vertical member of an object to be held down with the channel engaging the horizontal member to hold the object in place. Protrusions or other features are integrally formed in the weighted unit to allow the weighted unit to hang from the object to be weighed down without the weighted unit touching the ground. The horizontal channels are specifically formed to correspond to and communicate with the legs and/or other parts, both horizontal and vertical, of the object to be held down. The weighted unit may be placed directly over the top of a horizontal member of the object to be weighed down without also engaging, or being placed around, a vertical component of the same object.

Another aspect of the present disclosure includes protrusions or other features such as a U-bolt or other means of attaching the weighted unit to other objects by the use of ropes, straps or other means. A recessed or other handle may also by formed into the structure.

Another aspect of the present disclosure includes both raised notches and recessed notches formed to correspond with each other in stacking one weighted unit on top of another weighted unit.

Another aspect of the present disclosure includes the structure being formed with an internal void such that it can be filled with a substance in order to add to or subtract from the overall weight of the weighted unit.

Another aspect of the present disclosure includes it being formed out of recycled rubber, such as used tires, and having rounded outside edges.

Another aspect of the present disclosure includes a weighted unit comprising: a body having a first surface and an opposing second surface set at a distance therefrom, the body having opposing sides extending between the first and second surfaces; a first channel positioned in the second surface and running in a straight line along a length of the second surface from a first opposing side to a second opposing side such that the first channel is open to the first and second opposing sides; cavities positioned in the body on the second surface; and notches positioned in the body on the first surface.

Another aspect of the present disclosure includes a second channel positioned in the second surface and running in a straight line along a width of the second surface from a third opposing side to a fourth opposing side such that the second channel intersects the first channel and the second channel is open to the third and fourth opposing sides.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

Figure 1:
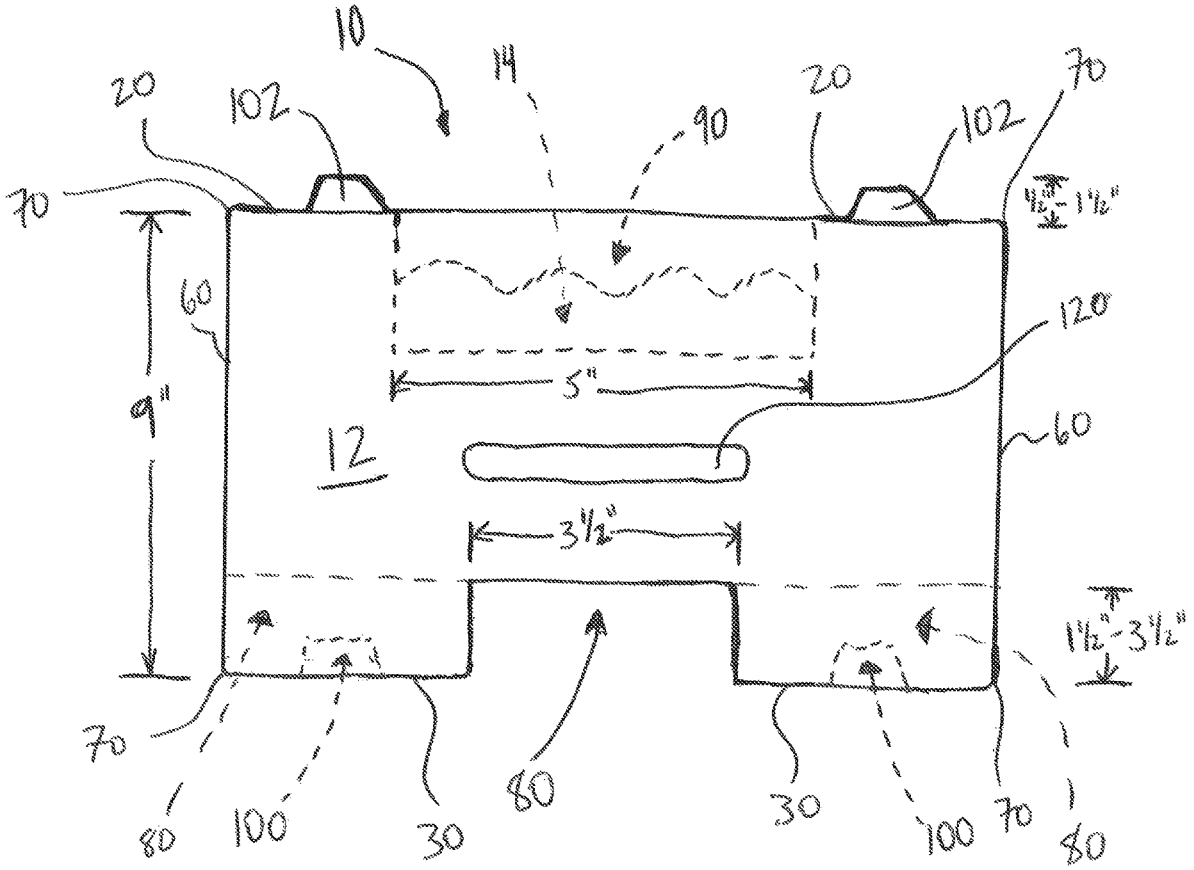
FIG. 1 is a front side-perspective view of an illustrative embodiment of a weighted unit in accordance with the present disclosure.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of a weighted unit 10. These embodiments may each comprise various structural and functional components that complement one another to provide the unique functionality and performance of the weighted unit 10, the particular structure and function of which will be described in greater detail herein.

Referring to the drawings, FIGS. 1-4 depict an illustrative embodiment of a weighted unit 10. Embodiments of the weighted unit 10 may comprise a body 12 having a first surface 20, a second surface 30 that substantially opposes the first surface 20, a front side 40, back side 50, and left/right opposing sides 60, although other shapes may be utilized depending on an object 2 the weighted unit 10 is designed to hold down. The body 12 may have a height, or depth, of 9" between the first surface 20 and the second surface 30. The length of the body may be 10" and width of the body may be 9". However, the length, width, and height (depth) of the body 12 may be adjustable, as needed.

Embodiments of the weighted unit 10 may comprise the dimensions of the weighted unit 10 varying depending on the needs of the end user and the application to which the weighted unit 10 is to be utilized. For example, for applications such as holding down traffic stands and signs, which need a substantial amount of weight to be held down in inclement weather or to be held for an extended length of time, the weighted unit 10 may be increased in size (i.e., weight, volume, or density) to accommodate an increased amount of ballast material, thereby increasing the overall weight of the unit 10 to accommodate the increased need for additional weight.

Additionally, for applications which do not require sizeable weight, the weighted unit 10 may be decreased in size. This reduction in size may be for applications which call for a smaller size, or less weight, such as for tents, canopies, pop-ups and the like. Such sizing may be a particular advantage to the end user for situations where the weighted unit 10 needs to be more manageable and transportable.

Embodiments of the weighted unit 10 may comprise rounded edges 70, especially on any outside edge, or corner edge. The rounded edge 70 may be implemented in one of a variety of ways. If the weighted unit 10 is configured with multiple layers, such as a separate inner and outer component, as described below, then the rounded edge 70 may be integrated into either one or both of the inner or outer components. An example of this configuration, for illustrative purposes, is where the inner component is manufactured using a rigid hard plastic, metal or wood and the outer component is manufactured using a composite material which is less rigid and more pliable, such as a composite made from recycled tires. The inner more rigid structure would be manufactured with rounded edges and the outer, more pliable layer would be overlaid on the inner structure and adhere to the inner structure's shape, thereby adhering and incorporating the rounded corner 70.

If the weighted unit 10 is configured with a single layer, then the rounded corners 70 may be integrated into the design and manufacturing process of that configuration. One advantage of the rounded edges 70 may be to keep other objects from getting damaged, should the weighted unit 10 come into contact therewith. Such may be the case during instances where the weighted unit 10 has incorporated therewith the ballast material and is sufficiently heavy enough to damage other objects.

Embodiments of the weighted unit 10 may comprise one or more grooves, holes, cut-outs, trenches, indentations, and/or channels 80. These channels 80 may be located on one or more of the first surface 20 and the second surface 30. For example, the channel 80 may be positioned in the second surface 30 and may run along a length or a width of the second surface 30. The channel 80 may be positioned along a center line, or may be positioned substantially in the center, of the width and/or the length. For instance, the channel 80 may run along the length of the second surface 30 at substantially a center of the width thereof. Likewise, the channel 80 may run along the width of the second surface 30 at substantially a center of the length thereof. Further, there may be more than one channel 80 traversing the weighted unit 10 along one axis, or the channel 80 may run along multiple axis, typically in an orthogonal manner, so as to be utilized in a variety of positions. Where more than one channel 80 is positioned in the second surface 30, the channels 80 may be configured to cross one another or intersect with one another to form a cross shape or a plus-sign shape (i.e., +), when viewed in a planar view.

In addition to the foregoing, the channels 80 could be specifically formed and/or also utilize a variety of configurations which would correspond to and communicate with the legs and/or other parts (both horizontal and vertical) of the object 2 to be held in place, such as a stand, tripod or barricade. The channels 80 may have an internal dimension, size, and shape. The channels 80 may have interior walls defining the channel 80. The inner walls may be oriented substantially orthogonal to one another and to the second surface 30, such that the cross-sectional shape of the channels 80 is substantially rectangular or square. Such a configuration may be most effective and efficient in allowing the channels 80 of the unit 10 to contact and engage the object 2 to hold the object 2 down against the ground on which object 2 and the unit 10 are placed. Such is the case, because typically the objects 2 to be held down are positioned on rectangular or square metal supports. Thus, the resulting engagement between the unit 10 and the object 2 is optimal for holding down the object 2 in times of inclement weather, such as high winds.

Of course, the channels 80 may also utilize other shapes, such as triangular or curved shapes on occasions where certain objects are designated in the design process as the object 2 to be held down by the weighted unit 10. In other words, the channels 80 of the weighted unit 10 may be formed of a size and shape correspond with and to engage an object 2 that the weighted unit 10 is specifically designed to hold down. This may be particularly useful for large traffic-signal signs, where long support members are utilized to support the traffic-signal sign on the ground.

In addition, the channels 80 may be dimensioned according to the design elements of the object 2 that the weighted unit 10 is designed to hold down. For example, the channel 80 may comprise dimensions of a substantially rectangular channel type indentation which is 3¼" wide by 3¼" deep.

Indeed, in some embodiments, the channel 80 is between 1½" and 3½" deep. Channels 80 may also be 3½" wide by 3½" deep. Channels 80 may further be 3" wide by 3" deep. Other typical channel measurements can be 2" wide by 3¼" deep. These typical dimensions are particularly useful when the weighted unit 10 is designed to hold down traffic signs and signals. Although the channels 80 may be dimensioned as set forth above, the weighted unit 10 may be designed with other dimensions, or may have multiple channels 80 with both the typical dimensions as well as indentions 80 with smaller or larger dimensions to accommodate multiple objects 2.

Embodiments of the weighted unit 10 may comprise a recessed handle 90 or other type of handle for easy mobilization. The recessed handle 90 may be incorporated into the structure of the weighted unit 10 with the top of the handle 90 being aligned or flush with the first surface 20 of the unit 10. The recessed handle 90 may be recessed into a void 14 which extends down into the body 12 from the first surface 20. The primary advantage of this configuration is to include a handle 90 for ease of mobilization, without impeding the potential for other weighted units 10*a* to be stacked upon each other.

Another type of handle 90*a* may include a raised rigid handle for grasping easily. The advantage of this type of handle 90*a* is that the rigid nature of the handle 90 may provide strength and stability when mobilizing, as well as avoiding having to design a void into the structure, which limits the amount of ballast material that can be added therein to increase the weight of the weighted unit 10. Additional options of the weighted unit 10 with a raised rigid handle 90*a* may also include a corresponding recessed portion in the second surface 30 of the weighted unit 10*a* stacked above, so as to facilitate unimpeded stacking.

Another embodiment of the handle 90*b* may include a handle 90*b* which is attached to the weighted unit 10 using a hinge or other type attachment so as to allow the handle 90*b* to be raised to a position for grasping, or lowered into a recessed portion for storage or to facilitate unimpeded stacking. While this configuration is not as rigid and strong as the embodiments illustrated above, the primary advantage is that it allows for ease of stacking without having to decrease the amount of space within the body 12 that might otherwise diminish the volume, weight, and/or size of the unit.

Additionally, the weighted unit 10 may incorporate more than one handle 90. These multiple handles 90 may be incorporated into any of the first surface 20, the front side 40, back side 50, and left/right side 60 surfaces. The primary advantage of having multiple handles 90 is for ease of mobilization by making the weighted unit easier to grasp and carry from any angle.

Typical dimensions for the handle (in any configuration) would be approximately 5" in length, which would accommodate most one-handed handle types without too much interference with the amount of space needed for the ballast material. Typical dimensions utilized for the recessed type handle would be approximately 5" in length by 4" in width by 3" in depth. Similarly, a raised handle would also be approximately 5" in length by 4" in width, but the top thereof would be 3" above the top surface 20. Therefore, the corresponding recessed portion in the bottom of the weighted unit 10*a* stacked above would be at least 3", as well.

Embodiments of the weighted unit 10 may include other features such as raised notches (or protuberances) 102 on the first surface 20 and corresponding notched-out cavities 100 on the second surface 30 of each unit 10. These raised notches 102 and corresponding notched out cavities 100 may allow the units 10 to be stacked on top of each other for storage or to add additional weight onto the stand or object 2 being weighed down and held in place. These notches 102 and cavities 100 may be configured to prevent or avoid a top unit 10 from sliding off of another bottom unit 10 on which the top unit 10 has been placed. For example, the cavities 100 may be positioned on the second surface 30 of the top unit 10 and the notches 102 may be positioned on the first surface 20 of the bottom unit 10 so that when the top unit 10 is placed immediately on top of the bottom unit 10, the cavities 100 of the top unit 10 contact and/or engage the notches 102 of the bottom unit 10. As a result, the physical interaction between corresponding cavities 100 and notches 102 may prevent or stop the stacked units 10 from being able to slide one another. Moreover, such physical interaction also provides increased structural stability when the units 10 are stacked on top of one another for additional weight.

Another advantage of positioning the notched-out cavities 100 on the second surface 30 is that such structure allows the entirety of the remaining portions of the second surface 30 (i.e., everything but the channels 80 and the notched-out cavities 100) to contact the ground on which the weighted unit 10 rests. This increased surface area being in contact with the ground, or other surface on which the weighted unit 10 is placed, provides better stability, as well as increased friction between the unit 10, the object 2, and/or the surface on which these rest. Such a configuration is advantageous over conventional configurations that may only utilize specific portions thereof, such as feet, or similar type arrangements, to come in contact with the ground or other surface to which the object is to be held down.

Embodiments of the weighted unit 10 may comprise the unit 10 having an internal void (not depicted) The internal void may be accessible through one of the first surface 20, the second surface 30, and/or one of the sides 40, 50, 60. The internal void may be configured to receive ballast material, such as fluid, liquid, sand, concrete, gravel, and the like, or any combination thereof, that serve to weigh down or add weight to the existing weight of the unit 10 itself. As such, the weight of the unit may be customized to meet the needs of the user. The ballast material may be removable, such as when water or sand are utilized.

Embodiments of the weighted unit 10 may include the body 12 being made out of more than one part, such as two or more parts. These parts may be formed separately and assembled and/or have an inner part and an outer part. For example, the body 12 may comprise an internal frame (not depicted) that may serve as the skeletal structure over which an outer skin (not depicted) may be placed. However, the weighted unit 10, after being assembled, may function as if it is one solid part, which is structurally sound, and able to provide weight as well as support weight.

Embodiments of the weighted unit 10 may also include the structure being made out of a variety of materials. These materials may include plastics, metals, woods, rubbers, composites and the like. Additionally, if the body 12 is made out of separate parts/materials (as described above), each part may be made out of similar or dis-similar materials. For instance, as an illustrative example, the inner part of the body 12 may be made out of plastic or metal, while the outer part may be made out of rubber or a composite material. Regardless of the material used, the resulting body 12 of the unit 10 may be configured to be resistant to the wear and tear, to the cuts and rips, and to the general abuse that renders sand bags and other conventional weights unusable.

Figure 2:
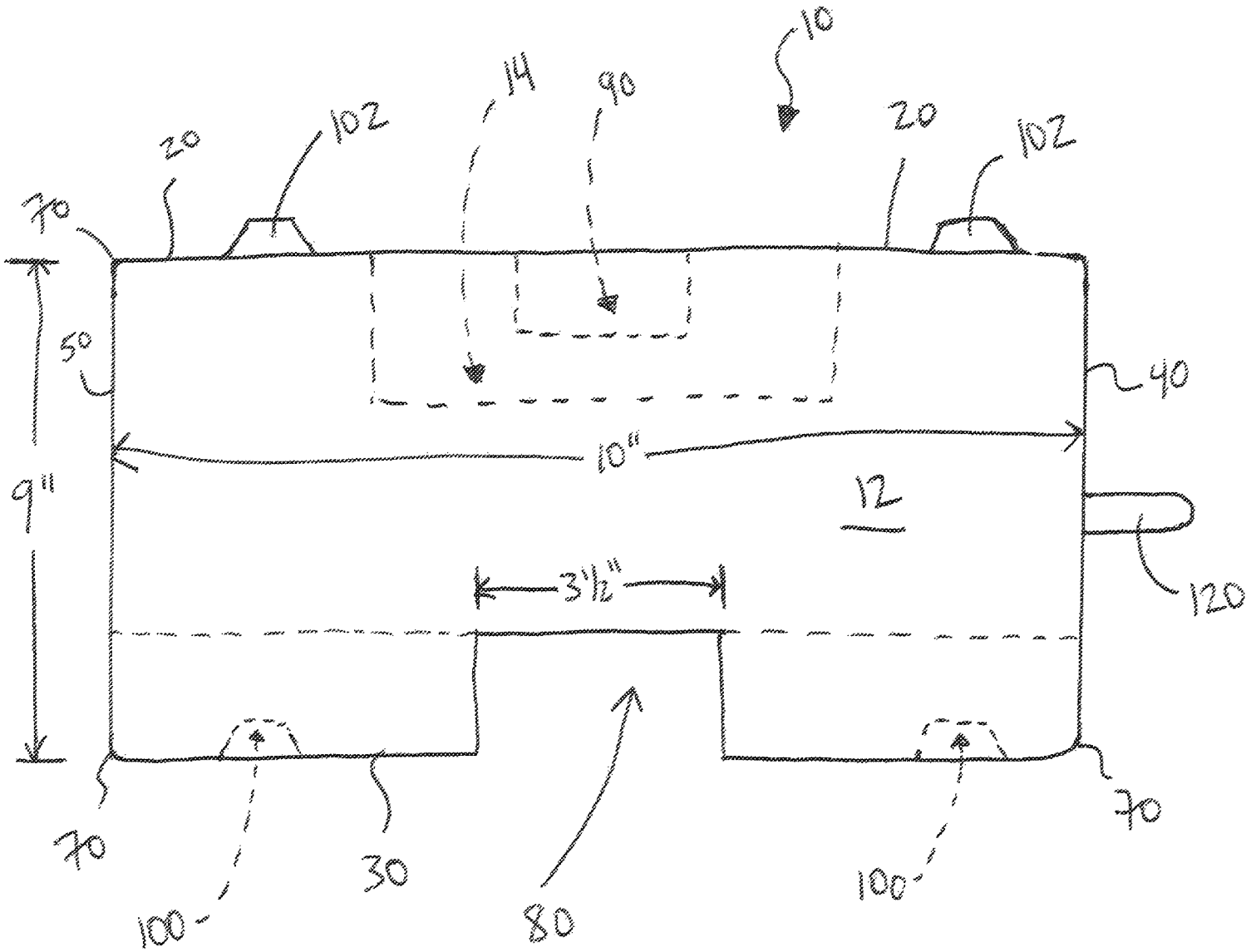
FIG. 2 is a side view of the illustrative embodiment of the weighted unit of FIG. 1 in accordance with the present disclosure.
Figure 3:
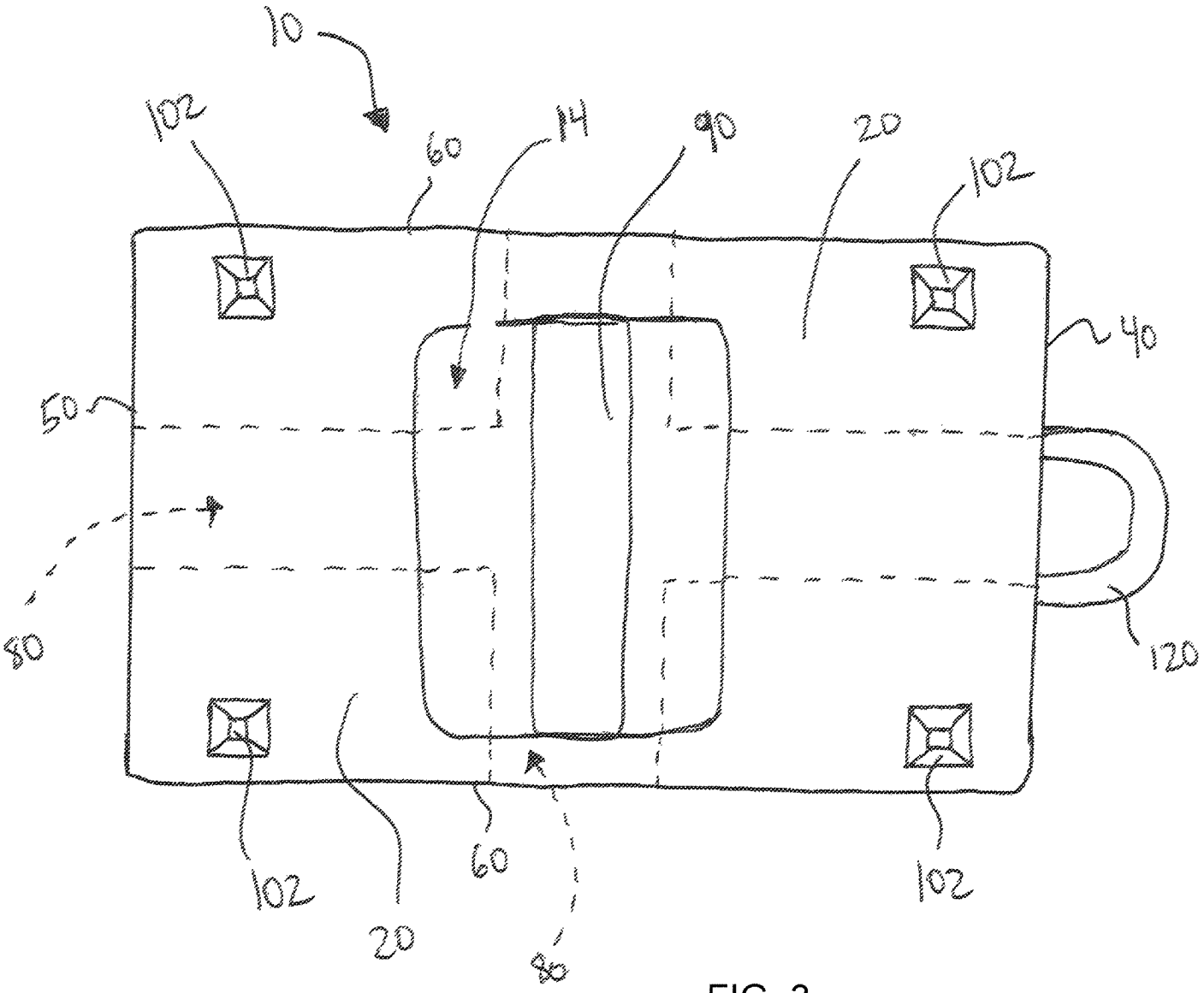
FIG. 3 is a top view of the illustrative embodiment of the weighted unit of FIG. 1 in accordance with the present disclosure.
Figure 4:
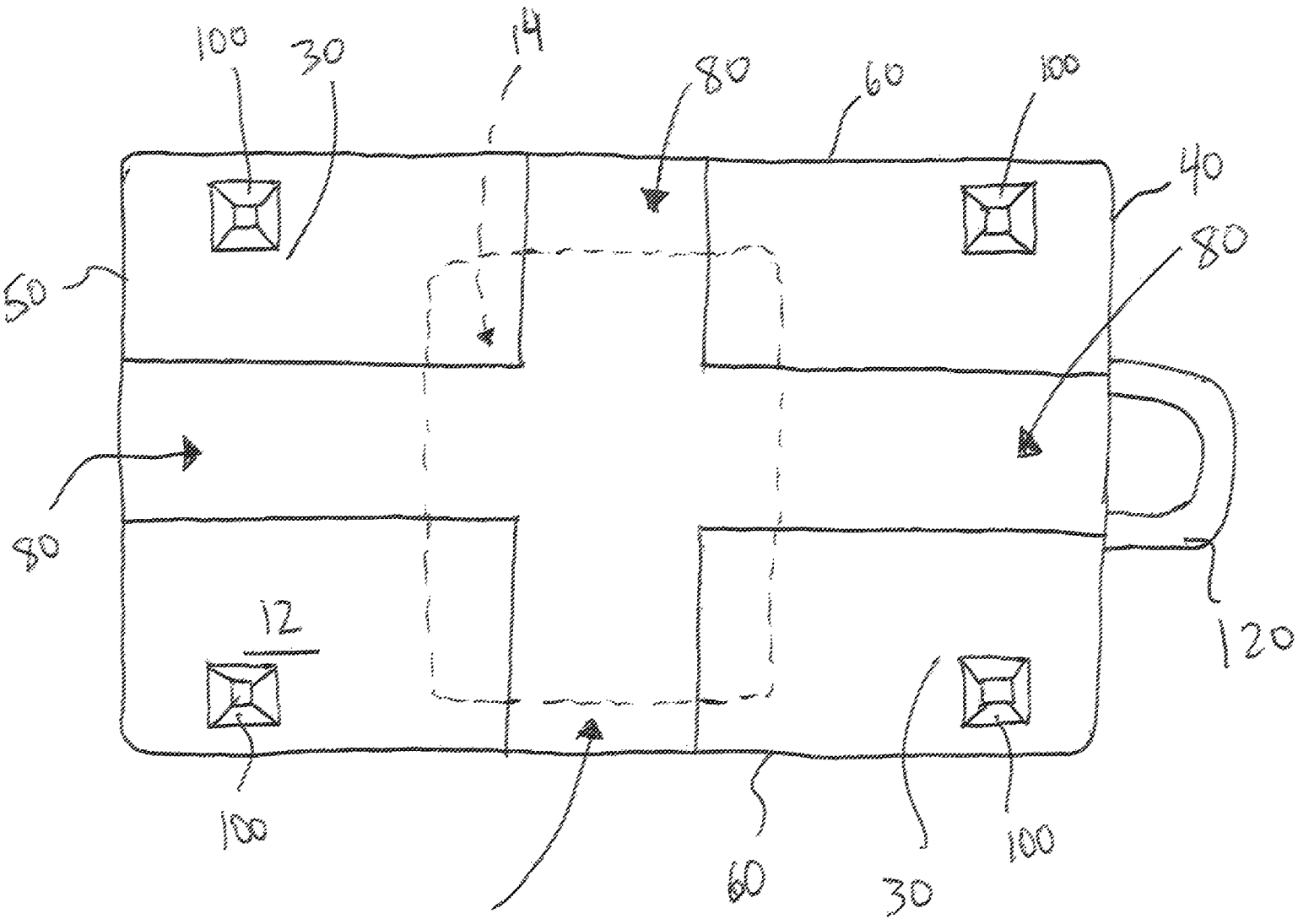
FIG. 4 is a bottom view of the illustrative embodiment of the weighted unit of FIG. 1 in accordance with the present disclosure.

Another embodiment of the weighted unit 10 may include secondary features. These features can be integrated into the unit as part of its form and structure, or as add-ons or accessories. These features may include hooks, bolts, tie-ons, and similar implements 120 that enhance the weighted unit's 10 utility and function by allowing the weighted unit 10 to be more readily attached to or positioned upon the stand or object 2 for which the weighted unit 10 is designed to engage. For instance, FIG. 2 shows an embodiment in which the implement 120 comprises a projection.

An illustrative example of these secondary features or implements 120 may include a U-bolt or other feature described above being integrated into one or more of the various sides of the body 12 of the weighted unit 10. This implement 120 (depicted as a U-bolt) may then be attached to a rope or other connecting medium, with the opposite end of the rope being connected onto a structure that has no horizontal component at ground level. For example, an A-frame type construction barricade, which has no ground level horizontal member, can be tied by a rope or other connecting medium to the weighted unit 10 by the implement 120, so as to avoid movement due to wind or other forces.

In another embodiment, the weighted unit 10 can be formed specifically to be used with objects or systems. In this embodiment, the weighted unit 10 can be manufactured to be incorporated with a specific tent, canopy, or traffic sign so that the structural configuration of the unit 10 matches and corresponds to the structure of the specific tent, canopy, or traffic sign alone. For example, the weighted unit 10 may be included in the tent or canopy packaging and be formed specifically for use with the horizontal or vertical members of that tent or canopy.

Conversely, the weighted unit 10 may be formed for use in a generic way for many situations. For instance, the weighted unit 10 may be manufactured in a way that it may be useable for a variety of different applications. In this embodiment, the weighted unit 10 can be made, not with a specific tent or canopy in mind, but with a "one size fits all" type of configuration that allows it to be utilized for many different types of tents, canopies, traffic stands and signs, and the like.

Additional embodiments of the weighted unit 10 may include the components being purchased pre-manufactured or manufactured separately and then assembled together. However, any or all of the components may be manufactured simultaneously and integrally joined with one another.

Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A weighted unit for holding down at least one of a traffic stand, a sign and another object, the weighted unit comprising:

a body having a first surface and an opposing second surfaces, the body further having opposing sides that extend between the first and second surfaces;

a first channel positioned in the second surface and running in a straight line along a length of the second surface from a first opposing side to a second opposing side such that the first channel opens from the first opposing side and the second opposing side;

a void that is defined in the first surface; and a handle that extends into the void; cavities positioned in the body at the second surface; and raised notches extending from the body at the first surface.

2. The weighted unit of claim 1, wherein the body defines an internal volume that is disposed between the first surface and the second surface and that is operable to be selectively filled with a ballast to increase a weight of the weighed unit.

3. The weighted unit of claim 1, wherein the first channel extends at least 1½ inches into the body from the second surface so as to be operable to receive a base member of at least one of the traffic stand and the sign.

4. The weighted unit of claim 1, wherein the first surface comprises a first substantially planar surface, and wherein the second surface comprises a second substantially planar surface.

5. The weighted unit of claim 1, wherein the first channel and the second channel divide the second surface into four quadrants, and wherein the cavities positioned in the body at the second surface comprise a first cavity, a second cavity, a third cavity, and a fourth cavity that each respectively extend into the body from the second surface at a corresponding one of the four quadrants.

6. The weighted unit of claim 1, further comprising a projection that extends from the body at one of the opposing sides, where the projection defines an opening.

7. The weighted unit of claim 6, wherein the projection comprises a U-shaped object that extends from one of the opposing sides of the body.

8. The weighted unit of claim 1, further comprising a second channel positioned in the second surface and running in a straight line along a width of the second surface from a third opposing side to a fourth opposing side of the body such that the second channel intersects the first channel and the second channel is open from the third opposing side, from the fourth opposing side, and from the second surface.

9. The weighted unit of claim 8, wherein the first channel and the second channel divide the second surface into four quadrants, and wherein a first quadrant and a second quadrant are disposed diagonally with respect to each other and respectively define a first cavity and a second cavity that extend into the body from the second surface.

10. The weighted unit of claim 9, wherein the first surface further comprises a first raised notch and a second raised notch, with the first raised notch and the second raised notch respectively corresponding in position to align with the first cavity and the second cavity.

11. A weighted unit that is operable to affix at least one of a traffic stand, a sign, and another object to a ground surface with a weight of the weighted unit, the weighted unit comprising:

a body having:

a first surface;

a second surface that is disposed substantially opposite to the first surface;

a first opposing side, a second opposing side, a third opposing side, and a fourth opposing side that each extend between the first surface and the second surface, wherein the first opposing side is disposed substantially opposite to the second opposing side, and wherein the third opposing side is disposed substantially opposite to the fourth opposing side;

a first channel that extends into the body from the second surface such that the first channel opens from the second surface, from the first opposing side, and from the second opposing side;

a second channel that extends into the body from the second surface such that the second channel intersects with the first channel and such that the second channel opens from the second surface, from the third opposing side, and from the fourth opposing side; a first raised notch that extends from the first surface; a first cavity that extends into the second surface; a void that is defined in the first surface; and a handle that extends across a portion of the void.

12. The weighted unit of claim 11, wherein the first surface comprises a first substantially planar surface, and wherein the second surface comprises a second substantially planar surface.

13. The weighted unit of claim 11, wherein the first cavity is defined in the second surface of the body on a first side of the first channel and a second cavity that is defined in the second surface of the body on a second side of the first channel.

14. The weighted unit of claim 11, further comprising a projection that defines an opening and that extends from at least one of the first opposing side, the second opposing side, the third opposing side, and the fourth opposing side.

15. A weighted unit that is operable to hold down at least one of a traffic stand, a sign and another object, the weighted unit comprising:

a body having:

a first surface;

a second surface that is disposed substantially opposite to the first surface;

a first opposing side, a second opposing side, a third opposing side, and a fourth opposing side that each extend between the first surface and the second surface, wherein the first opposing side is disposed substantially opposite to the second opposing side, and wherein the third opposing side is disposed substantially opposite to the fourth opposing side;

a first channel that extends into the body from the second surface such that the first channel opens from the second surface, from the first opposing side, and from the second opposing side;

a second channel that extends into the body from the second surface such that the second channel intersects with the first channel and such that the second channel opens from the second surface, from the third opposing side, and from the fourth opposing side;

a void that is defined in the first surface;

a handle that extends across a portion of the void;

a first cavity that is defined in the second surface of the body on a first side of the first channel;

a second cavity that is defined in the second surface of the body on a second side of the first channel;

a first raised notch that extends from the first surface; and a second raised notch that extends form the first surface, wherein the first raised notch and the second raised notch are respectively aligned in position with the first cavity and the second cavity.

16. The weighted unit of claim 15, further comprising a projection that defines an opening and that extends from at least one of the first opposing side, the second opposing side, the third opposing side, and the fourth opposing side.

17. The weighted unit of claim 15, wherein the first opposing side, the second opposing side, the third opposing side, and the fourth opposing side provide the body with a quadrilateral perimeter.

18. The weighted unit of claim 15, wherein the body defines an internal volume that is disposed between the first surface and the second surface and that is operable to be selectively filled with a ballast to increase a weight of the weighed unit.

19. The weighted unit of claim 15, wherein a portion of the handle runs substantially flush with the first surface.

20. The weighted unit of claim 16, wherein the first opposing side, the second opposing side, the third opposing side, and the fourth opposing side provide the body with a quadrilateral perimeter, wherein a portion of the handle runs substantially flush with the first surface, wherein the first surface comprises a first substantially planar surface, and wherein the second surface comprises a second substantially planar surface.

* * * * *